US007028737B2

(12) United States Patent
Hsu

(10) Patent No.: US 7,028,737 B2
(45) Date of Patent: Apr. 18, 2006

(54) VENETIAN BLIND FOR DAY/NIGHT USE

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/843,450

(22) Filed: May 12, 2004

(65) Prior Publication Data

US 2005/0252618 A1 Nov. 17, 2005

(51) Int. Cl.
*E06B 3/32* (2006.01)

(52) U.S. Cl. ..... 160/84.03; 160/115

(58) Field of Classification Search ..... 160/84.03, 160/89, 115, 167 R, 84.01, 84.04, 84.06, 160/168.1 R
See application file for complete search history.

(56) References Cited

U.S. PATENT DOCUMENTS

| | | | | |
|---|---|---|---|---|
| 4,799,524 | A * | 1/1989 | Guermonprez | 160/84.03 |
| 4,813,468 | A * | 3/1989 | Fraser | 160/84.03 |
| 4,953,610 | A * | 9/1990 | Phillips et al. | 160/84.03 |
| 5,121,783 | A * | 6/1992 | Nilsson | 160/89 |
| 6,516,856 | B1 * | 2/2003 | Lai | 160/89 |
| 6,648,048 | B1 * | 11/2003 | Lai | 160/115 |
| 6,854,502 | B1 * | 2/2005 | Lai | 160/89 |

* cited by examiner

*Primary Examiner*—David Purol
(74) *Attorney, Agent, or Firm*—Troxell Law Office, PLLC

(57) ABSTRACT

A Venetian blind for day/night use includes a fixed upper beam attached at the top of a door/window, a movable beam disposed beneath the fixed upper beam, and a lower beam disposed at the bottommost thereof wherein a light-penetrable folding blind (slats) with cord passing holes disposed thereon is attached between the fixed upper beam and the movable beam thereof, and a sheltering folding blind (slats) with cord passing slots distributed thereon is located between the movable beam and the lower beam thereof. The fixed upper beam has three equally spaced cord passages arranged at the bottom side thereon in alignment with three through holes disposed at the upper surface of the movable beam thereon. A sheltering-blind pull cord unit and a light-penetrable-blind pull cord unit are respectively led through engaging holes with locating members mounted therein at both lateral sides of the fixed upper beam thereof and extend downwards till fixedly tied up to the movable beam and the lower beam respectively. Thus, the Venetian blind thereof is variably operated to display either the light-penetrable or sheltering blinds or both of them for day/night use to meet the need of a user according to different situations, and economically designed with both light-penetrable and sheltering blinds combined into one unit and sharing the same fixed upper beam, movable beam, and the lower beam, etc., to achieve the economical efficiency thereof.

3 Claims, 6 Drawing Sheets

VENETIAN BLIND FOR DAY/NIGHT USE

BACKGROUND OF THE INVENTION

The present invention is related to a Venetian blind for day/night use, including a fixed upper beam attached at the top of a door/window, a movable beam disposed beneath the fixed upper beam, and a lower beam disposed at the bottommost thereof wherein a light-penetrable folding blind (slats) is attached between the fixed upper beam and the movable beam thereof, and a sheltering folding blind (slats) is located between the movable beam and the lower beam thereof; whereby, a light-penetrable-blind pull cord unit or a sheltering-blind pull cord unit is released to let down either the light-penetrable blind in the daytime or the sheltering blind in the nighttime; otherwise, both are released to display the light-penetrable and sheltering blinds for both light-penetrable effect as well as sheltering and privacy protection thereof. Thus, the Venetian blind thereof is variably operated for day/night use, and economically designed with both light-penetrable and sheltering blinds combined into one unit to achieve the economical efficiency thereof.

Please refer to FIG. 1. A conventional Venetian blind is made up of an upper beam 11, a light-penetrable (folding/Venetian) blind 12, a lower beam 13, a locating member 14, and two pull cords 15. The upper beam 11, fixedly attached at the top of a door/window, has one engaging through holes 111 disposed at one front lateral side thereon for the locating member 14 to be mounted thereto, and two cord passages 112 disposed at both bottom lateral sides thereon. The light-penetrable blind 12, sequentially folded up into multi-layers from top to bottom thereof, is attached between the upper beam 11 and the lower beam 13 thereof and equipped with left/right cord passing holes 121 equidistantly arranged thereon. The pull-cords 15 are led through the engaging through holes 111 and the locating member 14 at one side of the upper beam 11 as a unit before bifurcating into two branches to pass through the cord passages 112 at the bottom side of the upper beam 11 respectively. The two pull cords 15 coming out through the cord passages 112 of the upper beam 11 are sequentially extended downwards through the left/right cord passing holes 121 of the light-penetrable blind 12 thereof till tied up to left/right locating holes disposed at the upper surface of the lower beam 13 respectively to complete the assembly thereof.

In practical use, the pull cords 15 are drawn at one end to raise upwards the lower beam 13 attached at the other end thereof, permitting the uplifting lower beam 13 to fold up the light-penetrable blind 12 sequentially from the bottom side therewith till located at a proper height after the pulling force thereof stops working to display the light-penetrable blind 12 between the upper and the lower beams 11, 13 thereof.

Please refer to FIG. 2. Another conventional Venetian blind shows that a sheltering (folding/Venetian) blind 12' is attached between the upper and the lower beams 11, 13 thereof for the purpose of sheltering effect as well as privacy protection.

There are some drawbacks to such conventional Venetian blinds above. Most of all, both the light-penetrable (folding/Venetian) blind 12, and the sheltering (folding/Venetian) blind 12' are inconveniently fixed in operation. They are either displayed in full or located at a certain height for the single purpose of either light-penetrable or sheltering effect, which can't be variably operated with the dual functions of both light-penetrable and sheltering effects to meet the need of a user according to different situations.

SUMMARY OF THE PRESENT INVENTION

It is, therefore, the primary purpose of the present invention to provide a Venetian blind for day/night use, including a fixed upper beam attached at the top of a door/window, a movable beam disposed beneath the fixed upper beam, and a lower beam disposed at the bottommost thereof wherein a light-penetrable folding blind (slats) is attached between the fixed upper beam and the movable beam thereof, and a sheltering folding blind (slats) is located between the movable beam and the lower beam thereof; whereby, a light-penetrable-blind pull cord unit or a sheltering-blind pull cord unit is released to let down either the light-penetrable blind in the daytime or the sheltering blind in the nighttime; otherwise, both are released to display the light-penetrable and sheltering blinds for both light-penetrable effect as well as sheltering and privacy protection thereof, providing a Venetian blind that is variably operated for day/night use to meet the need of a user according to different situations.

It is, therefore, the second purpose of the present invention to provide a Venetian blind for day/night use wherein both the light-penetrable folding blind (slats) and the sheltering folding blind (slats) are combined into one unit, economically saving the space occupied. Besides, pull cords of the light-penetrable and sheltering blinds share the same fixed upper beam, movable beam, and lower beam, etc. efficiently achieving the economical efficiency thereof.

DETAILED DESCRIPTION OF THE PREFERRED EMBODIMENTS

Figure 1:
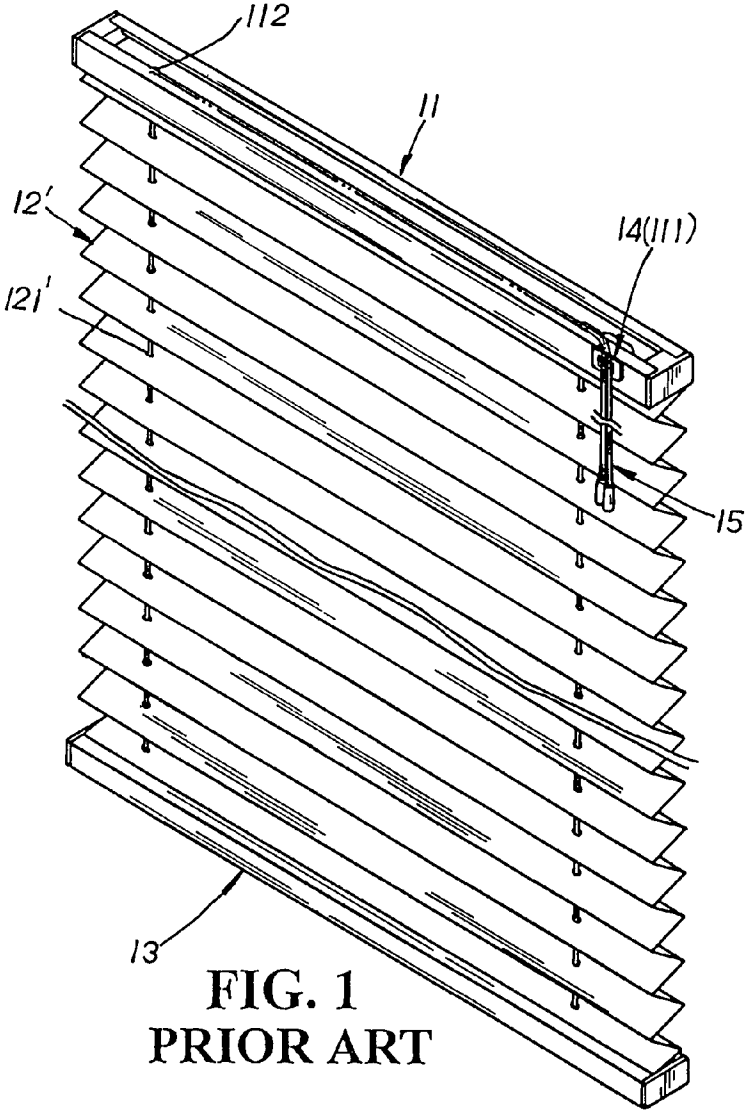
FIG. 1 PRIOR ART
FIG. 1 is a perspective view of a conventional Venetian blind.
Figure 2:
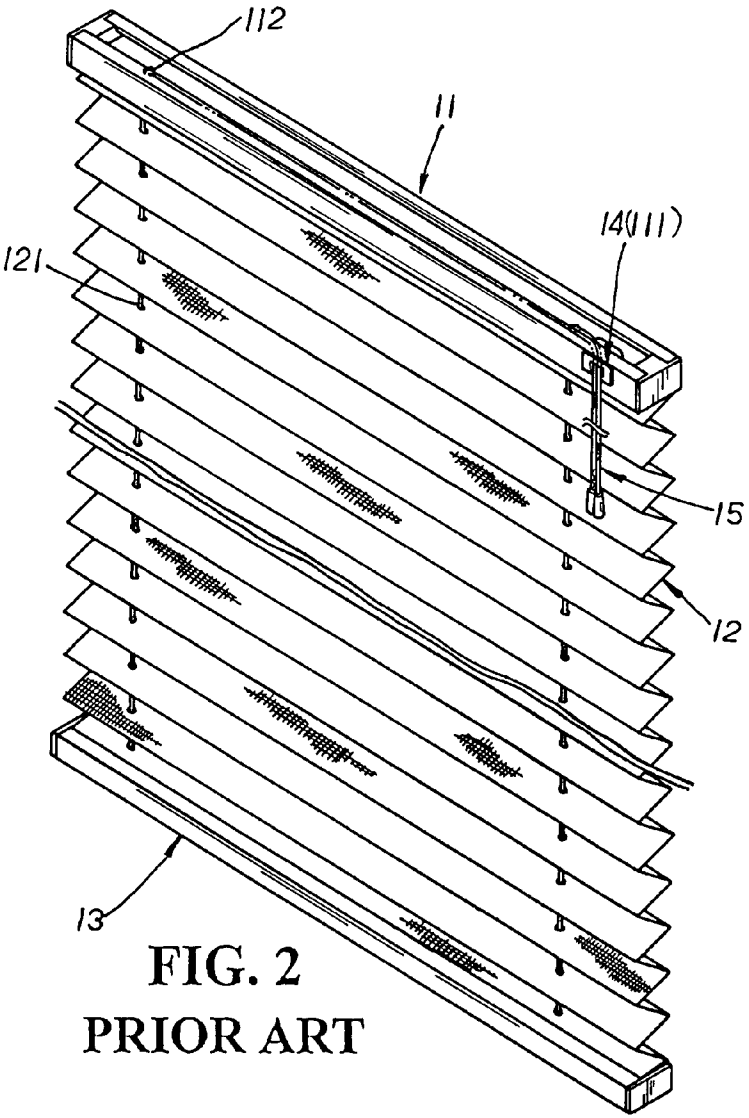
FIG. 2 PRIOR ART
FIG. 2 is a perspective view of another conventional Venetian blind.
Figure 3:
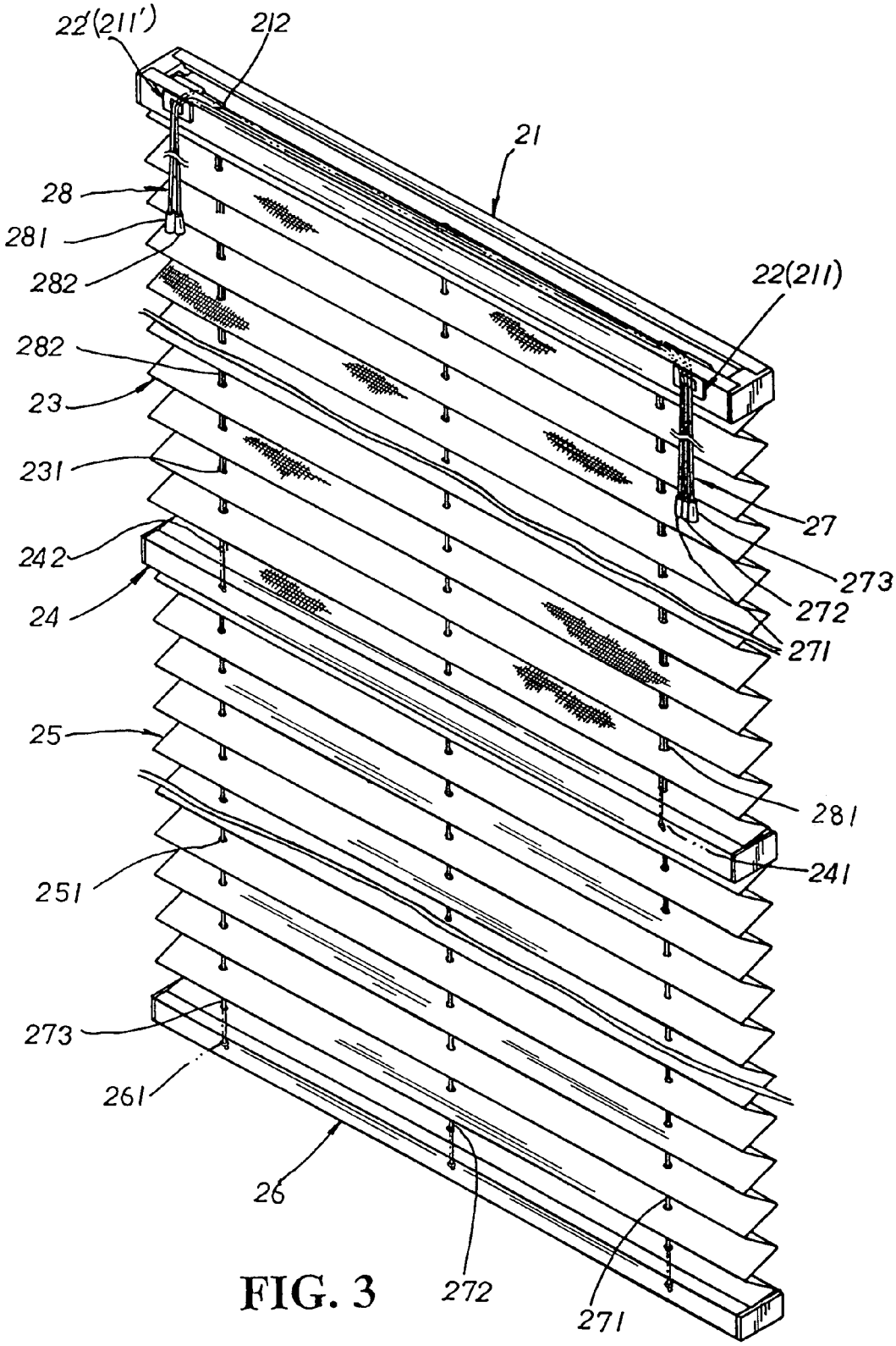
FIG. 3 is a perspective view of the present invention in assembly.

Please refer to FIG. 3. The present invention is related to a Venetian blind for day/night use, including a fixed upper beam 21, two locating members 22, 22', a light-penetrable folding blind (slats) 23, a movable beam 24, a sheltering folding blind (slats) 25, a lower beam 26, a sheltering-blind pull cord unit 27, and a light-penetrable-blind pull cord unit 28. The fixed upper beam 21, securely attached at the top of a door/window, is equipped with two engaging through holes 211, 211' disposed at the front lateral sides thereon for the two locating members 22, 22' to be mounted therein respectively, and three cord passages 212 equidistantly arranged at the bottom side thereon. The movable beam 24, located beneath the fixed upper beam 21, has three through holes 241 disposed thereon in alignment with the three cord passages 212 of the fixed upper beam 21 thereof, and left/right fixing holes 242 symmetrically disposed at the bottom side thereon. The light-penetrable blind (slats) 23, sequentially folded up into multi-layers from top to bottom and securely attached between the fixed upper beam 21 and the movable beam 24 thereof, is provided with a plurality of cord passing holes 231. The sheltering blind (slats) 25, sequentially folded up into multi-layers from top to bottom and securely attached between the movable beam 24 and the lower beam 26 thereof, is equipped with a plurality of cord passing slots 251. The lower beam, located at the bottom-most thereof, has three locating through holes 261 arranged in equal distance at the top surface thereon. The sheltering-blind pull cord unit 27 is made up of three strips, including first, second, and third sheltering-blind pull cords 271, 272, 273 to be led through the engaging through hole 211 and the locating member 22 disposed at one side of the fixed upper beam 21 as a unit before individually passed through the three cord passages 212 disposed at the bottom side of the fixed upper beam 21 respectively. The first/second/third sheltering-blind pull cords 271, 272, 273 coming out through the three cord passages 212 of the fixed upper beam 21 respectively are extended downwards through the cord passing holes 231 distributed at the light-penetrable blind 23 thereon and the three through holes 241 of the movable beam 24 till fixedly tied up to the locating through holes 261 of the lower beam 26 after coming out through the cord passing slots 251 of the light-sheltering blind 25 thereof respectively. The light-penetrable pull cord unit 28 includes first and second light-penetrable blind pull cords 281, 282 that are led through the engaging holes 211' and the locating member 22' disposed at the other side of the fixed upper beam 21 as a unit before bifurcating into two branches to pass through the cord passages 212 disposed at the left and right side of the fixed upper beam 21 respectively. The first/second light-penetrable pull cords 281, 282 coming out through the left/right cord passages 212 thereof are extended downwards through the cord passing holes 231 arranged at both left/right sides of the light-penetrable blind 23 thereof before led through the through holes 241 at both sides of the movable beam 24 and securely tied up to the left/right fixing through holes 242 disposed at the bottom side of the movable beam 24 respectively. Thus, the first and second light-penetrable blind pull cords 281, 282 are respectively juxtaposed with the first and third sheltering blind pull cords 271, 273 for a certain length at the fixed upper beam 21 and the movable beam 24 there-between.

Figure 4:
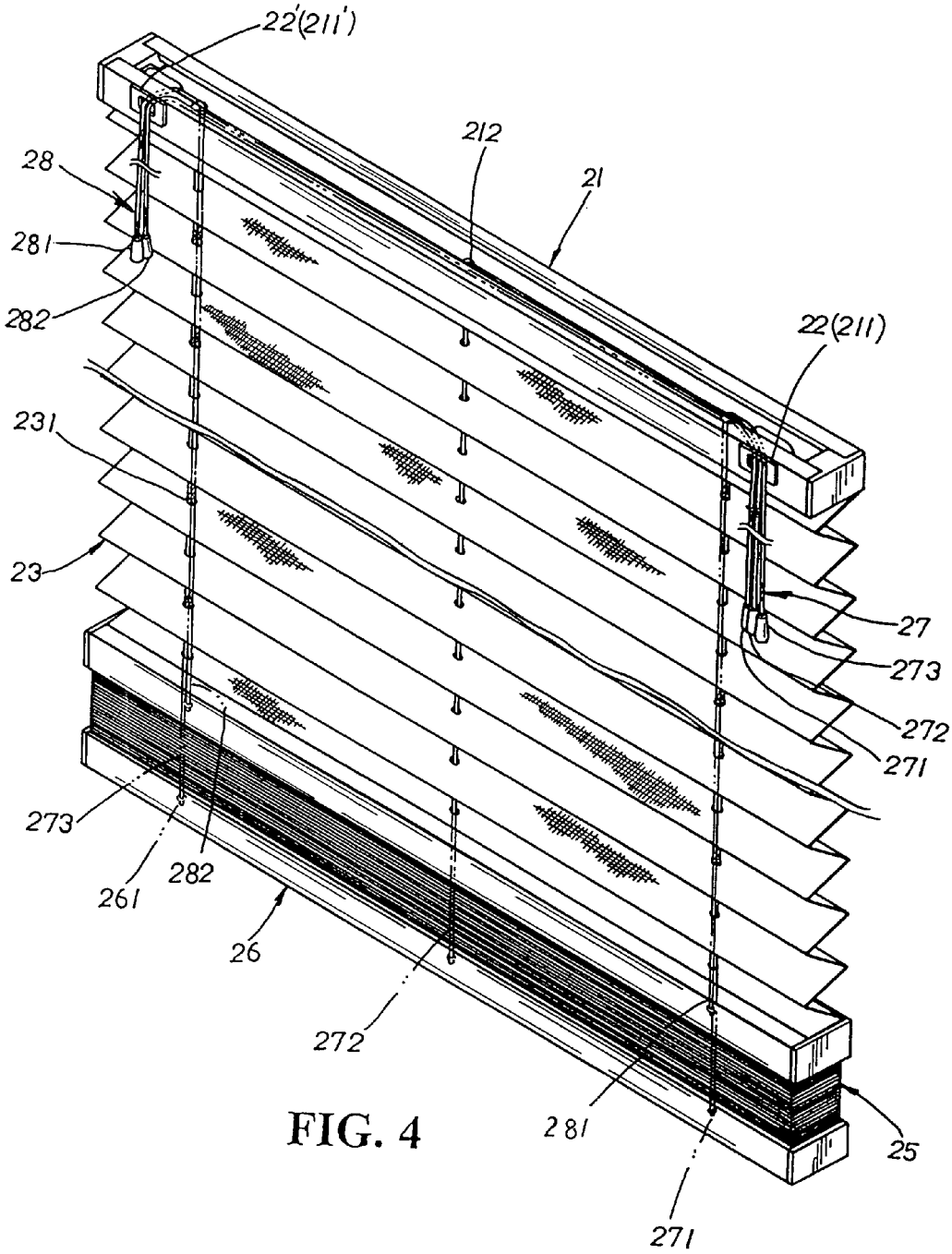
FIG. 4 is a perspective view of the present invention in operation.
Figure 5:
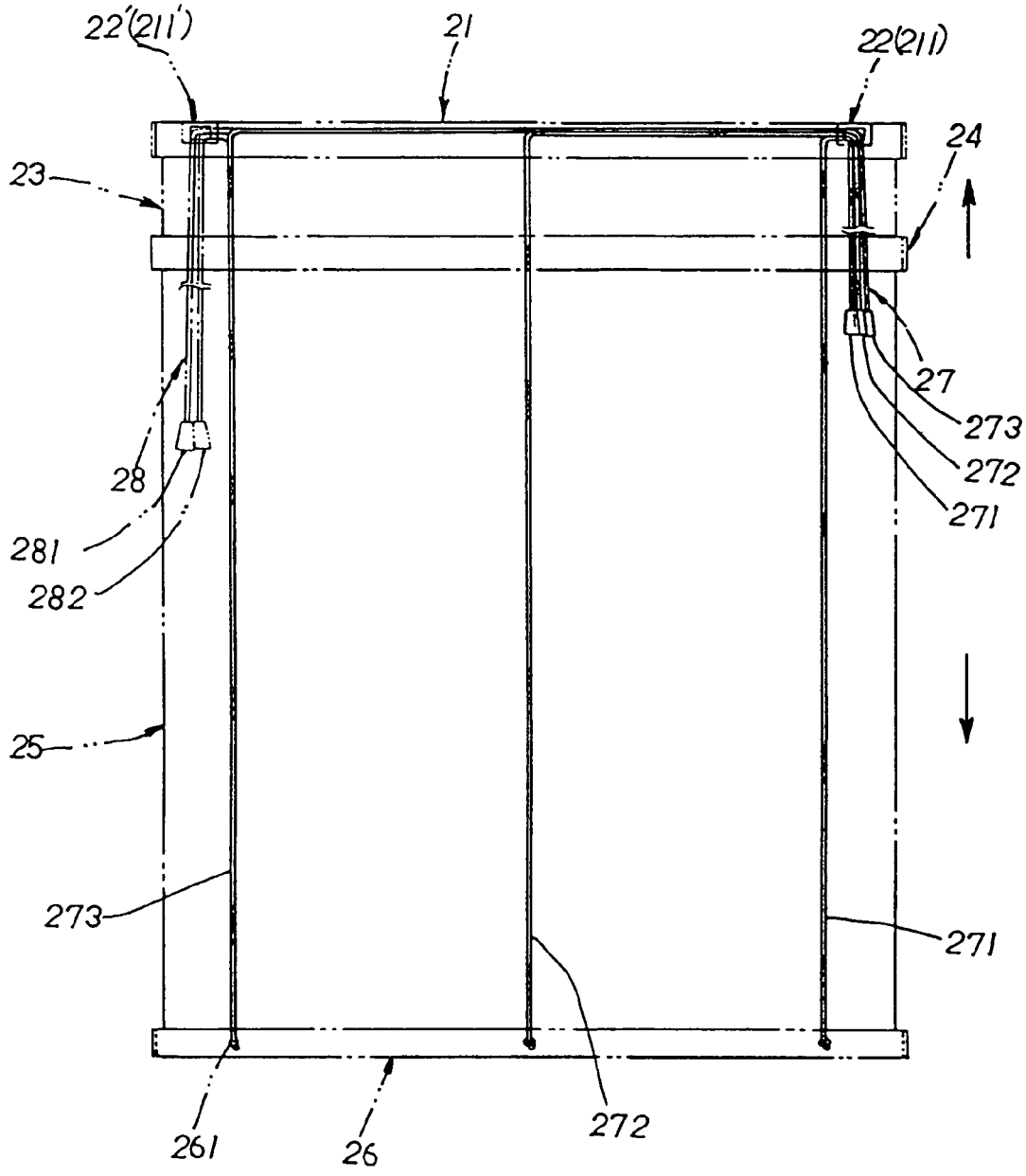
FIG. 5 is a plane view of the present invention in operation.

Please refer to FIGS. 4 to 5 inclusive. To use the light-penetrable folding blind (slats) 23 in the daytime, both the sheltering-blind pull cord unit 27 and the light-penetrable pull cord unit 28 are released, permitting the movable beam 24 and the lower beam 26 to descend downwards and sequentially unfold the light-penetrable blind 23 and the sheltering blind 25 therewith, providing a Venetian blind with dual-functions of both light-penetrable and sheltering effects. Otherwise, the light-penetrable pull cord unit 28 is simply released to descend only the movable beam 24 so as to display the light-penetrable blind 23 for the purpose of light-penetrable effect thereof.

Figure 6:
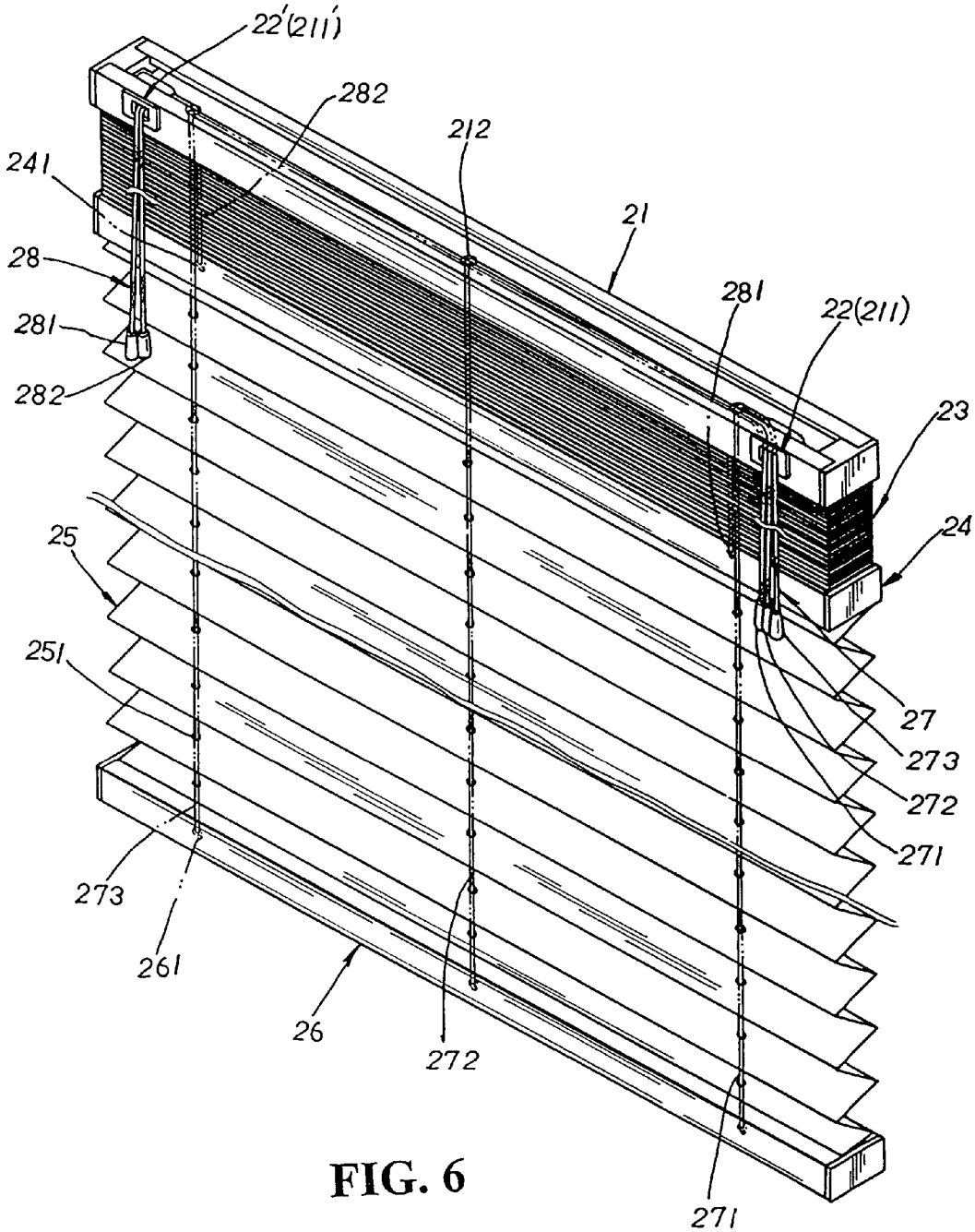
FIG. 6 is a perspective view of a variation of the present invention in operation.
Figure 7:
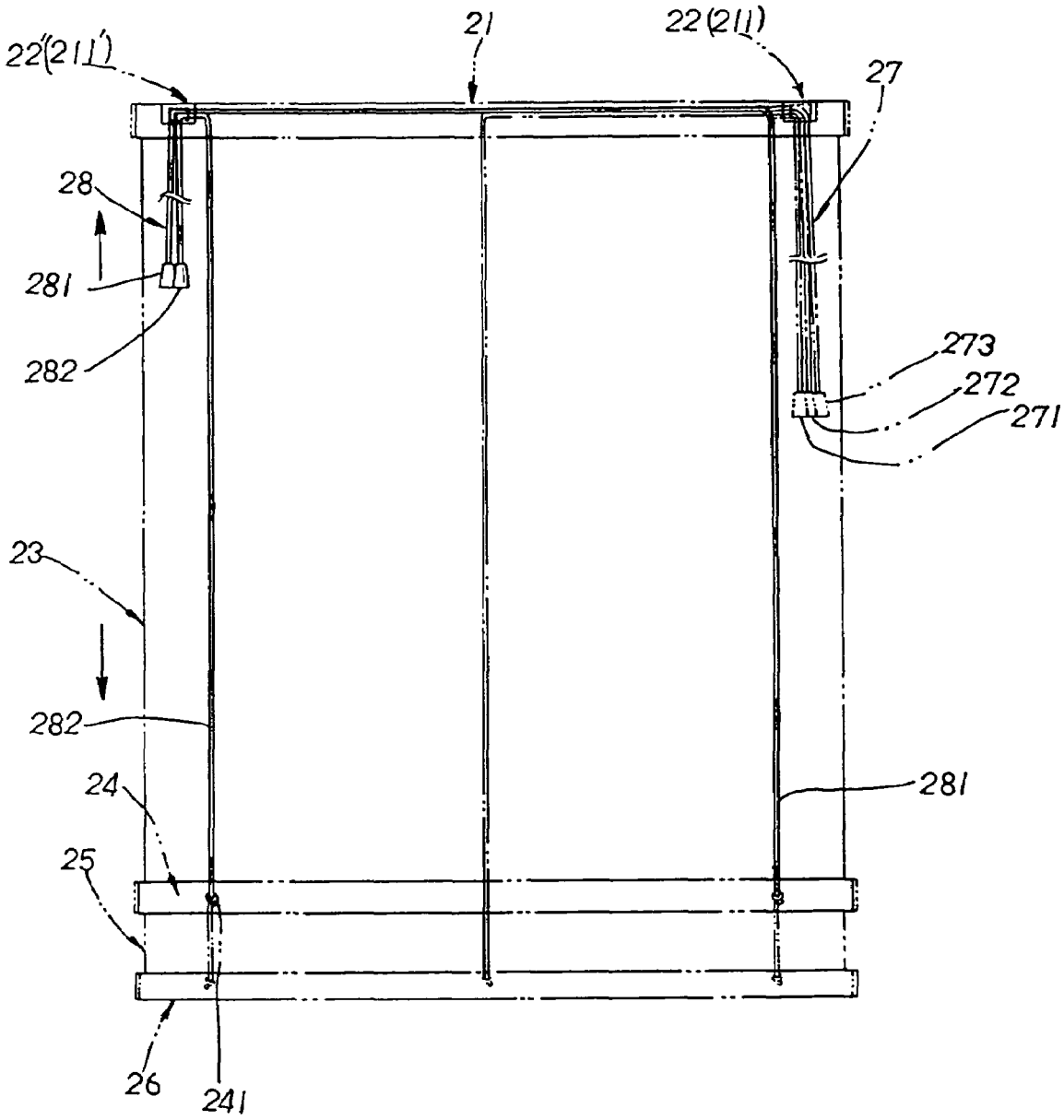
FIG. 7 is a plane view of another variation of the present invention in operation.

Please refer to FIGS. 6 to 7 inclusive. To use the sheltering folding blind (slats) 25 in the nighttime, the sheltering-blind pull cord unit 27 is released, permitting the lower beam 26 to descend downwards and sequentially unfold the sheltering blind 25 therewith for the purposes of both sheltering effect as well as privacy protection. Besides, both the movable beam 24 and the lower beam 26 are capable of being moved and located at-a certain height. Thus, the Venetian blind of the present invention is variably operated to display either the light-penetrable blind 23 or the sheltering blind 25, or both of them for day/night use according to the requirement of a user, and economically designed with both light-penetrable and sheltering blinds 23, 25 combined into one unit and sharing the same fixed upper beam 21, movable beam 24, and the lower beam 26, etc., efficiently saving the space occupied to achieve the economical efficiency thereof.

What is claimed is:

1. A blind assembly for day and night use comprising:

a) an upper beam having:

i) a first through hole;

ii) a second through hole;

iii) a first locating member connected to the upper beam above the first through hole;

iv) a second locating member connected to the upper beam above the second through hole; and v) three upper beam cord holes located between the first through hole and the second through hole;

b) a first blind connected to the upper beam at a top thereof and having a plurality of first slats, each of the plurality of first slats having three first blind cord holes;

c) a middle beam connected to a bottom of the first blind and having three middle beam cord holes and two fixing holes;

d) a second blind connected to the middle beam at a top thereof and having a plurality of second slats, each of the plurality of second slats having three second blind cord holes;

e) a lower beam connected to a bottom of the second blind and having three lower beam cord holes;

f) two first pull cords selectively adjusting the first blind to a predetermined position, one of the two first pull cords being inserted through the first through hole, each of two outer most holes of the three upper beam cord holes, each of two outer most holes of the three first blind cord holes, each of two outer most holes of the three middle beam cord holes and connected to each of the two fixing holes at an end thereof; and g) three second pull cords selectively adjusting the second blind to a predetermined position, one of the three second pull cords being inserted through the second through hole, each of the three upper beam cord holes, each of the three first blind cord holes, each of the three middle beam cord holes, each of the three second blind cord holes, each of the three lower beam cord holes, and connected to the lower beam at an end thereof, wherein one of the three upper beam cord holes aligning with each of the three first blind cord holes, the three middle beam cord holes, the three second blind cord holes, and the three lower beam cord holes.

2. The blind assembly according to claim 1, wherein the first blind is a light-penetrable blind.

3. The blind assembly according to claim 1, wherein the second blind is a sheltering blind.

* * * * *